United States Patent [19]

Kankaanpaa

[11] 4,016,032

[45] Apr. 5, 1977

[54] SUCTION ROLL FOR TRANSFERRING A WEB AWAY FROM A PRESS SECTION

[75] Inventor: Matti Kankaanpaa, Tapiola, Finland

[73] Assignee: Valmet Oy, Finland

[22] Filed: Apr. 14, 1975

[21] Appl. No.: 568,140

Related U.S. Application Data

[63] Continuation-in-part of Ser. No. 310,805, Nov. 30, 1972.

[30] Foreign Application Priority Data

Dec. 20, 1974 Finland ..... 3720/74

[52] U.S. Cl. ..... 162/305; 162/360 R; 162/368; 162/372

[51] Int. Cl.[2] ..... D21F 3/04

[58] Field of Search ..... 162/359, 360 R, 369, 162/370, 371, 372, 290, 305, 306, 366, 368

[56] References Cited

UNITED STATES PATENTS

| | | | |
|---|---|---|---|
| 1,832,974 | 11/1931 | Farnsworth | 162/371 |
| 3,861,996 | 1/1975 | Dorfel | 162/360 X |

FOREIGN PATENTS OR APPLICATIONS

| | | | |
|---|---|---|---|
| 699,107 | 12/1964 | Canada | 162/360 R |

*Primary Examiner*—S. Leon Bashore
*Assistant Examiner*—Richard V. Fisher
*Attorney, Agent, or Firm*—Steinberg & Blake

[57] ABSTRACT

A paper-machine press section having structure for transferring a web away from the press section toward the drying section of the machine. The press section includes a press roll with which a transfer structure cooperates for transferring a web from this press roll away from the latter and toward the drying section. This transfer structure includes at least a transfer suction roll having an outer shell formed with perforations through which suction is transmitted to a web. A suction chamber communicates with these perforations while between the suction chamber and the outer shell which has the perforations there is a sealing structure which is capable of providing between the perforated shell and the suction chamber a seal which does not require the use of seal water.

29 Claims, 7 Drawing Figures

SUCTION ROLL FOR TRANSFERRING A WEB AWAY FROM A PRESS SECTION

CROSS REFERENCE TO RELATED APPLICATION

This application is a continuation-in-part of application Ser. No. 310,805, filed Nov. 30, 1972, and entitled PRESS ASSEMBLY IN A PAPER MACHINE.

BACKGROUND OF THE INVENTION

The present invention relates to paper-manufacturing machines.

In particular, the present invention relates to the press section of a paper machine. As is well known such a press section receives the web from the wire and dewaters the web as much as possible so that when the web travels from the press section to the drying section, the load on the drying section will be reduced as much as possible.

In particular, the present invention relates to structure for transferring the web away from the press section when it starts to travel therefrom toward the drying section.

As is well known, particular problems are encountered in the press section because of the desirability of moving the web at high speed so as to achieve a high output while at the same time seeking to dewater the web as much as possible and subjecting the web to as small stress as possible so as to avoid undesirable tearing of the web.

In order to solve the above problems it has been proposed to provide a press section where the web sequentially undergoes a plurality of nips where water is removed from the web, utilizing at these nips rolls capable of efficiently dewatering the web by way of suction as well as various forms of openings formed in the surfaces of the rolls. In addition, in order to fully support the web at all times as it travels through the press section, so as to reduce stressing of the web to a minimum, the press section is arranged in such a way that throughout the entire path of travel of the web through the press section this web is in engagement with felts or rolls so that at no time is the web unsupported as it travels the web section.

However, a particular problem is encountered in detaching the web from the press section as it travels away from the latter toward the drying section.

Thus, the present invention relates in particular to this latter problem especially in connection with that type of press section where the web is continuously supported along its entire path through the press section, although the transfer structure of the invention for detaching the web from the press section is of general utility so that it can also be used with press sections, for example, which do not necessarily provide continuous support for the web throughout the press section.

It is commonly known in paper machines to detach the web from the surface of a rotating press roll while transferring the web, during maintenance of the continuity thereof, to the next treatment stage, with the arrangement being such that the velocity of the web at the latter stage is greater than at the press roll. As a result the detaching of the web is carried out by way of a differential linear web velocity providing a traction in the web. This traction of course stresses the web since it tends to stretch the latter, and the web is not always capable of tolerating such traction since the web under these conditions may break, thus undesirably interrupting the continuous production and resulting in production losses.

One of the characteristic features of modern paper machines resides in the fact that they operate at high speeds. The higher the speed of the machine the shorter the time during which the web is subjected to the effect of pressure at the nips between the rolls of the press section. This factor of course detracts from the dewatering capacity of the press section and it becomes necessary, therefore, in order to render the operation of the press more efficient, to use relatively high pressing forces when the machine operates at high speed. However, this increase in pressure necessarily results in providing a greater adherence of the web to the surface of a smooth press roll engaged by the web, and thus detaching of the web from this smooth press roll becomes difficult. As a result of this latter factor, the tendency of the web to suffer from rupture increases and production losses resulting from breakage of the web increase correspondingly. These problems encountered with ruptures in the web occur particularly at the edge regions of the web.

An additional area where problems are particularly encountered is in connection with detaching of the web from a press roll of the press section in order to start the web on its way to the drying section. For such detachment of the web it is possible to use a pick-up felt and a suction roll cooperating therewith. Such structure is indeed known in connection with transfer of the wet web from the wire to the press section of the machine. However, a conventional suction roll consistent in its design and operation with a wire suction roll or a press suction roll and operating to detach the web from the wire is not suited for use in the press section. The reason for this is that the design and principle of operation of such a roll does not permit it to operate satisfactorily under the particular conditions encountered in detaching the web from the press section so that it will then continue to travel on to the drying section. Such conventional suction rolls have within a foraminous shell a suction box the length of which equals that of the shell, this suction box being connected with a suction system. The suction box is provided with sealing foils which are urged against the inner surface of the roll shell. In order to reduce the extent to which wear takes place between the foils and the surface slidably engaging the same, water is conventionally sprayed onto the interior surface of the suction roll. This water forms seal water cooperating with the sealing foils to achieve the required seal between the latter and the inner surface of the shell while at the same time reducing the friction therebetween. The amount of seal water which may be used can be on the order of 50 liters per minute per meter of machine width. Part of this water to provide a seal while reducing friction is flung by centrifugal force through the perforations or holes in the shell of the roll. As a result this water reaches and is absorbed by the pick-up felt, spreading through the latter and into the paper web itself. In addition, it can happen that as a result of defective nozzles on the spray pipe the water is not uniformly distributed across the machine width, or in other words along the axis of the suction roll. This latter factor will result in a detrimental effect on the moisture profile of the web because the moisture will of course be sharply different at different parts of the web, considered transversely of the machine.

When the web is detached from the wire, the water content of the web is so high that introduction of seal water into the pick-up felt and partly into the web itself usually is of no particular consequence. On the other hand, if in the press section there is a detaching suction roll of such conventional design, then the quantity of seal water as compared with the quantity of the water remaining in the paper web at the last press nip is so great that it will substantially impair the operational effeciency of the press. For example, if the dry matter content of the web increases at the last press nip from 37% to 40%, with a machine speed of 800 m/min and a basis weight of 50 g/m$^2$ of the web, then it follows that water is withdrawn from the web at the press section at a rate of about 8 liters per minute per meter of machine width. However, an equal amount of water or even more water, may be reintroduced into the web from the seal water of the detaching suction roll situated subsequent to the last press nip. Such a detaching suction roll placed in the press section cannot be given a relatively large diameter. The necessarily small diameter of this roll results in a considerable centrifugal force, and therefore it cannot be avoided that water will be flung about through the perforations of the shell into the paper web in great abundance.

As has been pointed out above, a large number of breaks in the web will start at the margins of the web during detachment thereof from the press section. This large number of breaks which start at the margin results from the fact that the web margins may lack homogeneity and may even be inferior in strength as a result of unsatisfactory operation of the headbox and of the wire section. Moreover, the ease with which the web starts to tear at its margins is at least in part a result of the air current created by the rotating rolls and the like which cause fluttering of the web.

SUMMARY OF THE INVENTION

It is accordingly a primary object of the present invention to provide for the press section of a paper machine a construction which will avoid the above drawbacks.

In particular, it is an object of the present invention to provide for a press section of the paper machine the capability of detaching the web from the press section while avoiding problems which are normally encountered in connection with seal water of conventional suction rolls.

It is furthermore an object of the present invention to provide for press section a transfer means for transferring a web away from the press section with a suction roll constructed in such a way that even though it may be inefficient inso far as dewatering is concerned it is on the hand extremely efficient and highly effective with respect to the suction applied to the web. Since effective dewatering is no longer of any particular consequence at the very end of the press section where the web is detached therefrom, it is far more important to have an efficient suction than an efficient dewatering at this point, and according to one of the objects of the present invention advantage is taken of constructions which previously were considered to be poor because of their poor dewatering capability event though an effective suction could be achieved by such constructions.

Furthermore it is an object of the present invention to provide a suction roll which is constructed in such a way that the load imposed on the apparatus which provides the suction is reduced to a minimum because of the efficiency with which the structure of the invention operates with respect to the application of suction to the web at the point where the latter is detached from the press section so as to travel therefrom on to the drying section.

Furthermore, an exceedingly important object of the present invention is to provide a construction which will act very effectively at the margins of the web during detachment thereof from the press section so that there will be no tendency for breaks to start in the web at the margins thereof.

It is also an object of the present invention to provide a construction of the above type which will effectively counteract blowing.

Moreover, it is an object of the present invention to provide a construction which will not provide the web with different appearances or textures at different parts thereof so that the web when treated with the structure of the invention will have a highly desirable uniform appearance over its entire area.

According to the invention the paper machine has a press section means for dewatering a web received by the press section means from a wire while the web travels through the press section means toward a drying section of the machine. This press section means includes a press roll and a transfer means cooperating therewith for transferrng a web from the press roll away from the latter toward the drying section. This transfer means includes at least a transfer suction roll means having an outer rotary shell formed with perforations through which suction is applied to a web, a suction chamber means communicating with these perforations of the shell, and a seal means between the suction chamber means and the shell for sealing, without the use of seal water, an area through which the suction chamber means communicates with the perforations of the shell at any given instant.

Thus, in order to avoid the drawbacks referred to above, according to the present invention the suction roll means is urged against the press roll at the web detachment point with a paper machine felt or fabric cooperating with the suction roll means and being conducted through the nip defined between the suction roll means and the press roll. The web is transferred onto the surface of the felt or fabric and is made adherent to the latter by the action of a vacuum prevailing in the suction zone of the suction roll means located at the above nip. The web is thus supported and conveyed by this felt as it is transported beyond the press roll away from the latter toward the drying section of the paper machine, and, as pointed out above, the suction roll has the construction of a transfer suction roll which does not use seal water.

The transfer suction roll means of the invention has a sandwich type of shell construction in that it is provided with a totally or partly foraminous outer shell and a non-perforated inner shell surrounded by the outer shell while between the shells there is a system of suction shells forming a cellular structure a given sector of which communicates with a section system by means of a stationary end piece which forms a suction chamber means.

As has been pointed out above, one of the important objects of the invention is to assure that at the point of detachment of the web from the press section there will be no tendency of the web to break particularly with such breaks starting at the margin thereof. This avoiding of such breaks is achieved by arranging the suction so that it acts primarily at the opposed ends of the suction roll. However, in order not to overload the vacuum system, the suction may be omitted entirely at the central region of the web in those cases where in consideration of the runability quality of the paper being manufactured such an operation is permitted. In order to counteract blowing, the surface of the detaching roll may be provided at its central region with grooves or with openings which extend only partly through the outer shell so as to not to pierce the latter. However, these openings which do not pierce through the outer shell at the central region thereof are provided with a configuration and a distribution consistent with that of those perforations which pierce through the shell at the region of their roll ends so that in this way the effect of the perforations on the paper, in the form of more or less visible markings, will be uniform across the entire web.

Suction rolls having a cellular structure as referred to above are in themselves known, as shown, for example, in Finnish Pat. No. 18,972. Suction rolls of this type have been used as suction rolls in the wire section of a paper machine. However, their dewatering capacity has been limited and because of the way they are constructed they impose an extra undesirable load on the vacuum system. However, when a cellular suction roll is used for the purposes of the present invention at the point of detachment of the web from the press section, the only point of significance is that a vacuum be created at a surface of the felt after a plurality of press nips. The dewatering capacity of such a suction roll at this particular part of the machine is of no special significance. Moreover, as will be apparent from the description below, the particular features of the cellular suction roll according to the present invention enables the desired suction to be achieved with an extremely low air consumption.

Thus, in this latter connection, the load which is imposed on the suction pump which is connected to the suction roll is affected not only by the quantity of air passing through the web opposite to the suction zone but also by the quantity of air present in the spaces within the suction roll itself, these spaces being made up of the perforations or holes as well as the cells through which suction is applied to the felt and the web engaging the same. Thus, the thicker the foraminous shell of the suction roll or the larger the cells thereof the greater the amount of additional air which will be carried into the suction system and which must be removed in addition to the air which travels through a paper web and/or the felt in order that a vacuum maintaining the web in a position adhering to the felt can be achieved. A small additional quantity of air arrives into a suction system from locations where there is an unavoidable leakage at the seals.

With the suction roll construction according to the present invention, however, this additional air required by the construction of the suction roll itself is minimized by restricting the combined capacity of the openings or perforations passing through the outer shell and the cells between the inner and outer shells, in such a way that the resulting volume of these opening or perforations and cells will be at a minimum, as will be apparent from the description below.

BRIEF DESCRIPTION OF DRAWINGS

The invention is illustrated by way of example in the accompanying drawings which form part of this application and in which.

DESCRIPTION OF PREFERRED EMBODIMENTS

Figure 6:
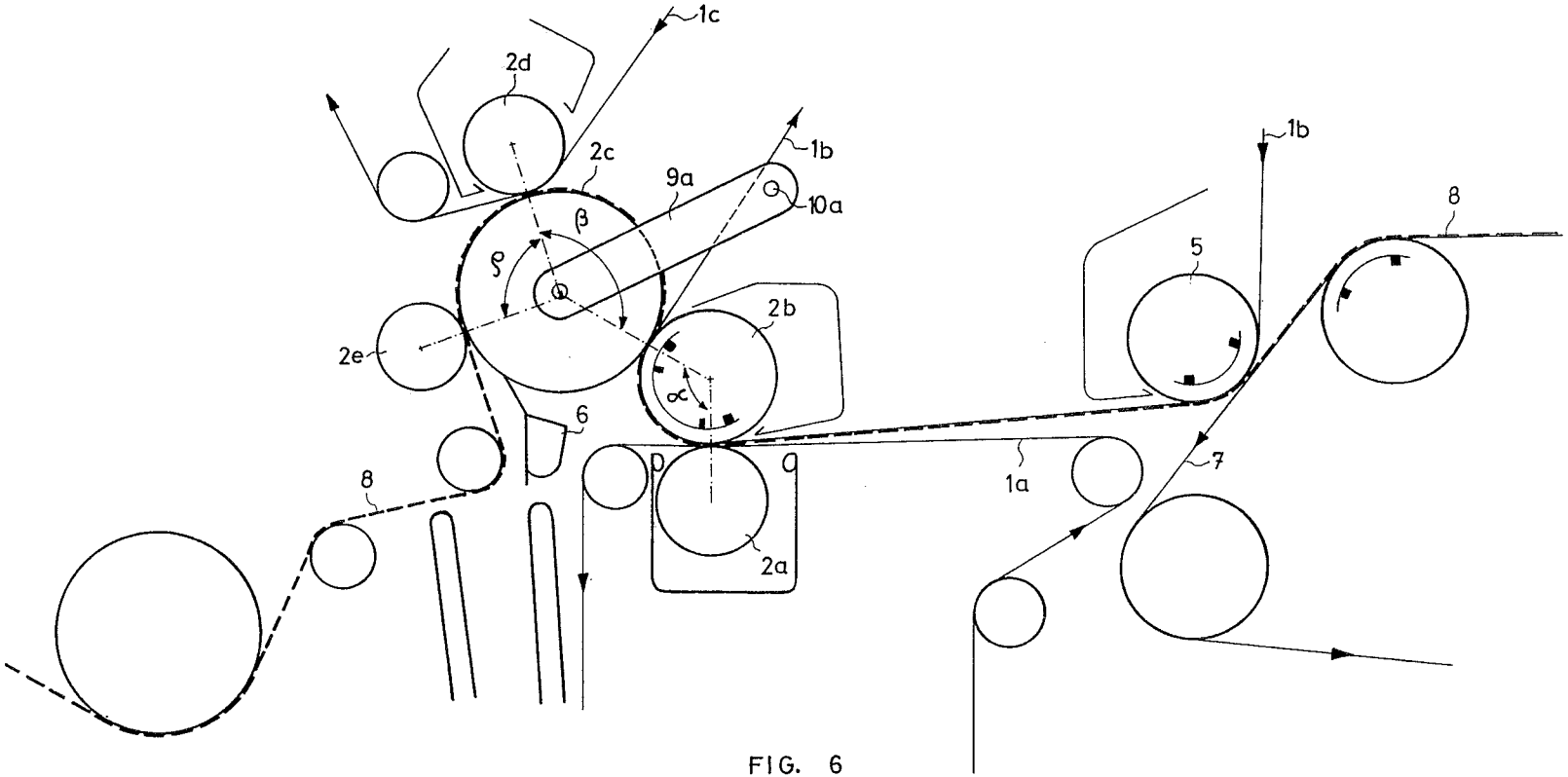
FIG. 6 is a schematic illustration of that part of a paper machine which can use the structure of the invention.
Figure 7:
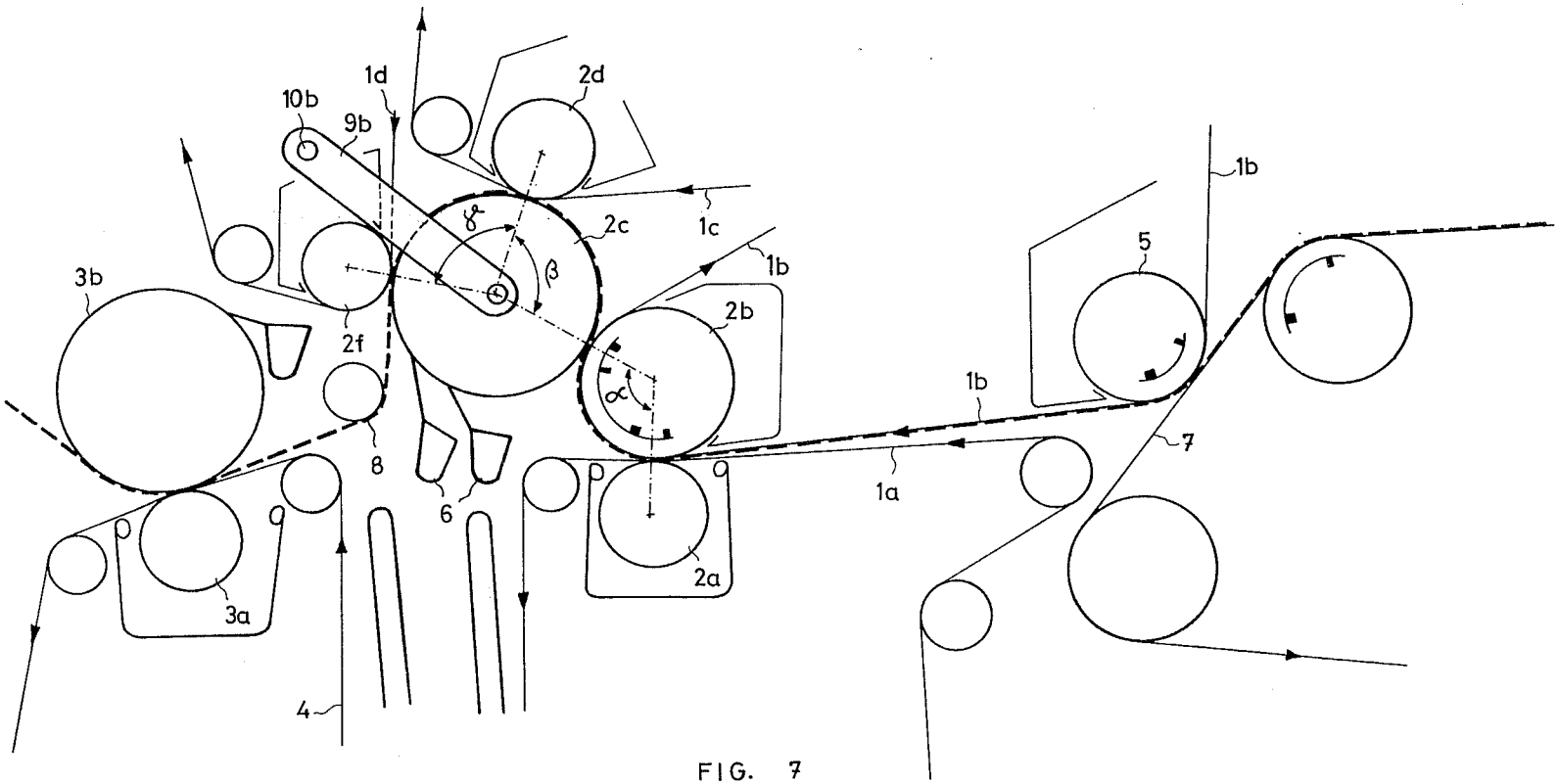
FIG. 7 shows a further embodiment of a part of a paper machine for utilizing the structure of the invention.

Referring first to FIGS. 6 and 7, there are illustrated therein press sections of paper machines, these press sections being particularly suited for the present invention and being constructed in such a way that while they are extremely compact and are capable of subjecting the web to a plurality of sequential nips for effective dewatering, at the same time the web is supported along its entire path of travel through the press section, either by a press roll or a felt, so that at no time is the web unsupported as it is dewatered while travelling through the press section.

In the press section of FIG. 6, the paper web 8 is taken off the wire 7 by the aid of a pick-up roll 5, whereby the paper web 8 is transferred in a so-called closed run onto the felt 1*b* passing over the roll 5 and arrives, carried by this felt, at the first press nip, which is defined by the rolls 2*b* and 2*a*. Also through this process nip 2*a*/2*b* passes the felt 1*a*, whereby the paper web travels through the nip enclosed between two felts. The rolls 2*a* and 2*b* are both efficiently dewatering rolls having cavities in their surface. After the first press nip, the paper web 8 travels in a closed run, that is attached to the felt 1*b*, to the second press nip 2*b*/2*c*. The roll 2*c* is a smooth-surfaced roll and has been fitted with a doctor device 6; of course, there may be more than one doctor. At the press nip 2*c*/2*b*, dewatering takes place at right angles against the upper surface of the paper web, that is in the direction towards the roll 2*b*. From the second press nip, the paper web goes over to the roll 2*c* and thence further to the third press nip 2*c*/2*d*, through which also the felt 1*c* passes. At this press nip, dewatering takes place in the same way as in the second press nip, that is through the upper surface of the paper web. The angle $\alpha$ in FIG. 6 is within the range of 90° to 150° and angle $\beta$ is between 70° and 160°.

From the third press nip the paper web may be conducted into the drying section. However, in the embodiment of FIG. 1 the press assembly furthermore comprises a roll 2*e*, which together with the roll 2*c* defines a so-called equalizing press nip. The roll 2*e* is disposed at an angular distance $\rho = 70°$ to 160° from the press nip 2*c*/2*d*.

The embodiment of FIG. 7 is, up to the third press nip 2*c*/2*d*, substantially similar to that shown in FIG. 6. In FIG. 7 there has been shown, instead of the roll 2*e* of FIG. 6 a fourth efficiently dewatering roll 2*f* placed so as to be contiguous with the smooth surfaced roll 2*c* and which roll 2*f* is disposed within a felt loop 1*d* of its own. The rolls 2*c* and 2*f* define the press arrangement of a fourth press nip 2*c*/2*f*, having a distance from the third press nip 2*c*/2*d* of the press assembly equivalent with the arc Γ. The angle Γ is within the range of 70° to 160°.

The mutual distances of the press nips, in arrangements as shown in FIGS. 6 and 7, are mainly dependent on the framework of the press assembly. The large diameter smooth-surfaced roll 2*c*, which is the mating roll in the second, third and fourth nips, is carried by lever arms 9*a* (FIG. 6) or 9*b* (FIG. 7), respectively, having their pivots 10*a*, 10*b* in the frame portion over roll 2*c*, so that the lever arms 9*a*, 9*b* are criented with reference to the vertical most usually at an angle of 25° to 40° in the direction of the entering (9*a*) or leaving (9*b*) paper web. When the lever arms, such as arms 9*a*, have an inclined position pointing towards the direction of the entering paper web, the second and third nips have to be angularly spaced far apart about the roll axis, at about 120° to 160°, while the angular distance between the third and fourth nip is about 70° to 120° in this case. If again, the lever arms, such as arm 9*b*, are inclined, pointing in the direction of the leaving paper web, the corresponding arc distances are those above indicated.

According to FIG. 7, the paper web 8 is conducted, after the fourth press nip 2*c*/2*f*, into the nip 3*a*/3*b* defined by the pair of rolls 3*a*, 3*b*. This pair of rolls comprises an efficiently dewatering roll 3*a* within a felt loop 4 of its own, and a smooth roll 3*b*. In the nip 3*a*/3*b*, dewatering takes place, with reference to the plane of the web 8, in the direction opposite to that in the fourth, third and second nips preceding this nip 3*a*/3*b*.

As regards, in practice, the designs of the different rolls 2 and their different alternatives, these rolls may be, for instance, of following kinds:

The roll 2*a* may be a suction roll, a recessed surface suction roll or a recessed surface roll (grooved roll, blind hole drilled roll, roll with plastic wire covering, etc.). If a recessed surface roll, it may be a flexible or flexure-compensated roll, or a completely normal roll.

The roll 2*b* may be a suction roll provided with one or several suction zones, or a recessed surface roll in general.

For the rolls 2*d* and 2*f* similar structures can be considered as for the roll 2*a*.

Roll 2*c* as well as roll 2*e* may be rolls having a smooth, hard or soft surface.

Figure 1:
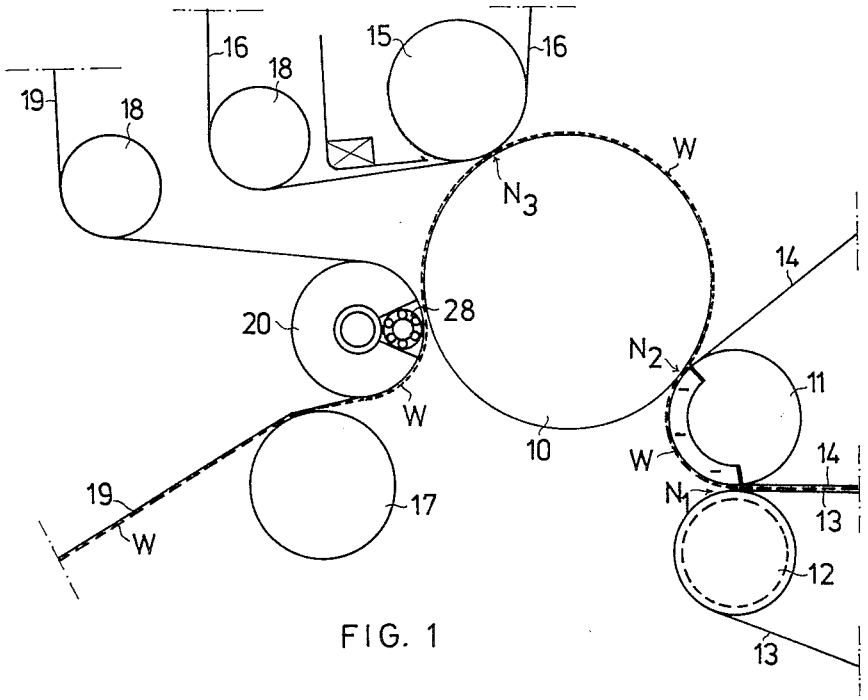
FIG. 1 is a schematic illustration of a press section of a paper machine, this press section including in particular a transfer suction roll means according to the invention.

FIG. 1 illustrates a press section similar to that of FIGS. 6 and 7 wherein the procedures and structures of the present invention are utilized to a particular advantage. Thus, as may be seen from FIG. 1, the press section illustrated therein includes a central press roll 10 of comparatively large diameter. The first nip of the press section is defined by the rolls 11 and 12, roll 11 being a suction roll and roll 12 having a recessed surface such as a surface which is suitably grooved. The roll 11 is situated within and engaged by an endless felt 14 while the roll 12 is situated within and engaged by an endless felt 13. Thus, the web W initially passes between the felts 13 and 14 as it travels through the first nip $N_1$.

The suction roll 11 defines together with the central roll 10 and the second nip $N_2$ of the press section. The third nip $N_3$ is defined by the central roll 10 and the press roll 15. This press roll 15 is situated within the loop of an endless felt 16 which engages the roll 15 and presses against the web W at the nip $N_3$. The endless felt 16 is guided by a guide roll 18 as illustrated.

The press section may have additional nips such as a fourth and even a fifth press nip, as is apparent from the description above in connection with FIGS. 6 and 7.

This press section means of FIG. 1, as described above, has at a location corresponding to the location of the roll 2*e* of FIG. 6 or the roll 2*f* of FIG. 7 a transfer means which includes a suction transfer roll means 20 having a particular construction according to the present invention. This transfer means includes in addition to the suction transfer roll means 20 an endless felt loop 19 so that the transfer means has its own pick-up felt provided with a guide roll 18 as illustrated at the upper left part of FIG. 1. According to the invention the transfer suction roll means 20 is urged against the central press roll 10 of the press section means at the point of detachment of the web W so that the web is transferred onto the pick-up felt 19 of the transfer means, adhering to the surface of the felt 19 as a result of the action of vacuum at the suction zone α (FIG. 4) of the suction roll 20. The web W while thus supported and carried along by the felt 19 is conveyed to the drying section of the paper machine. The guide roll 17 of the felt 19 is situated as close as possible to the suction roll 20.

According to one of the important features of the present invention, the suction roll 20 is a cellular suction roll having cells and perforations with which a suction chamber means communicates and with a seal means being provided between the suction chamber means and the shell, this seal means of the invention operating without seal water, so that in this way the moisture content of the web is not undesirably increased at its point of detachment from the press section.

The construction of the suction roll means 20 of the invention is apparent from FIGS. 2–5. Thus it will be seen that the suction roll means 20 of the invention has a pair of coaxial shells 21 and 22, the shell 21 being an outer shell while the shell 22 is an inner shell situated within and surrounded by the outer shell. Between these shells the suction roll means includes a system of suction cells 32, this system including a cell-defining means made up of partitions 34 which are situated substantially within radial planes which contain the axis of the suction roll 20. The outer shell 21 is formed with perforations 33 which pierce therethrough. This shell 21 may be made of bronze, for example. The outer shell has a constant wall thickness throughout the entire outer shell. The inner shell 22 may consist appropriately of a steel tube which is machined so as to taper in such a way that at a central region of the shells, between opposed end regions thereof, the volume or cross-sectional area of the cells is smaller than at the end regions. These partitions 34 which form the cell-defining means may be made, for example, of steel or another suitable metal. These strips 34 which form the partitions are fixed in any known way to the inner surface of the outer shell and the outer surface of the inner shell. The several partitions 34 may extend parallel to the axis of the roll 20 or they may be curved so as to extend along spirals thus being helically arranged in the space between the shells 21 and 22. These cells 32 which are defined by the partitions 34 are long and narrow, as is apparent from FIGS. 2–4, and in the illustrated example these cells extend from the center of the roll toward the opposed ends thereof where the cells are open, in the case where suction is provided at both ends of the cells, or where the cells are closed at one end of the roll 20 in the case that suction is provided only at the opposite end thereof.

Figure 4:
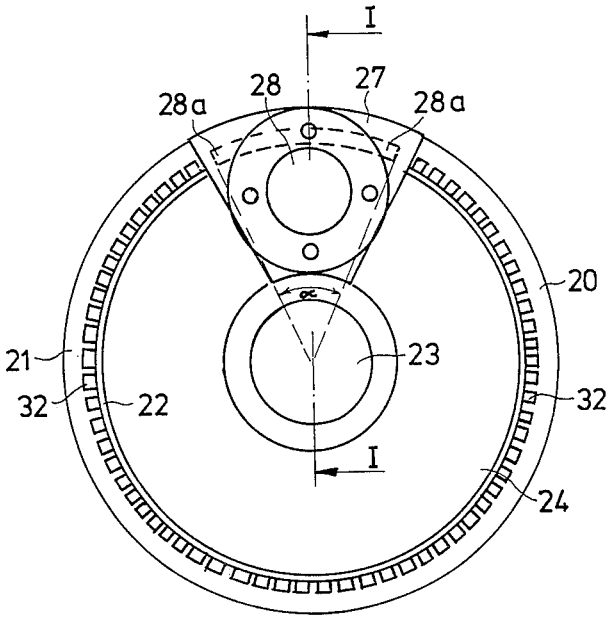
FIG. 4 is an end elevation of the transfer suction roll means of the invention.

A suction chamber means 27 is provided to connect the system of suction cells 32 with a vacuum pump, for example. This suction chamber means 27 is in the form of a tubular structure situated at both ends of the roll where the cells 32 are open at both ends thereof or at only one end of the roll where the cells 32 are closed at the opposite end thereof. The width or dimensions of the hollow interior 28 of the suction chamber means 27 determines the number of cells which communicate at any given instant with the suction system as illustrated by the arrow B in FIG. 2. Thus, as is apparent particularly from FIGS. 2 and 4, the hollow interior 28 of the suction chamber means is circular at the region of the outer end thereof which is distant from the shells 21 and 22 and which is provided with a suitable connecting flange for connecting the tubular structure extending to the suction pump. At its opposite end 28*a*, however, the hollow interior of the suction chamber means 27 is of an arcuate configuration extending along the circle along which the outer ends of the cells 32 extend, as illustrated in FIG. 4, so that in this way a given number of cells within the angle $\alpha$ shown in FIG. 4 will at any given instant communicate with the source of suction.

The suction chamber means 27 serves in part to mount a bearing assembly 25, 26 which serves to support the shaft 23 for rotation about its axis, this shaft 23 being driven in a known way and being fixed to the end wall 24 of the suction roll means 20. At the end of the suction roll means 20 which is not illustrated in FIGS. 2 and 4, the construction is identical with that shown in FIG. 4 in the case where the system of suction cell is opened at both ends of the suction roll means, while in the case where the end of the suction roll opposite from that illustrated in FIGS. 2 and 4 has the suction cells closed, only the structure shown in FIGS. 2 and 4 will be provided in connection with placing the cells in communication with a source of suction.

Figure 2:
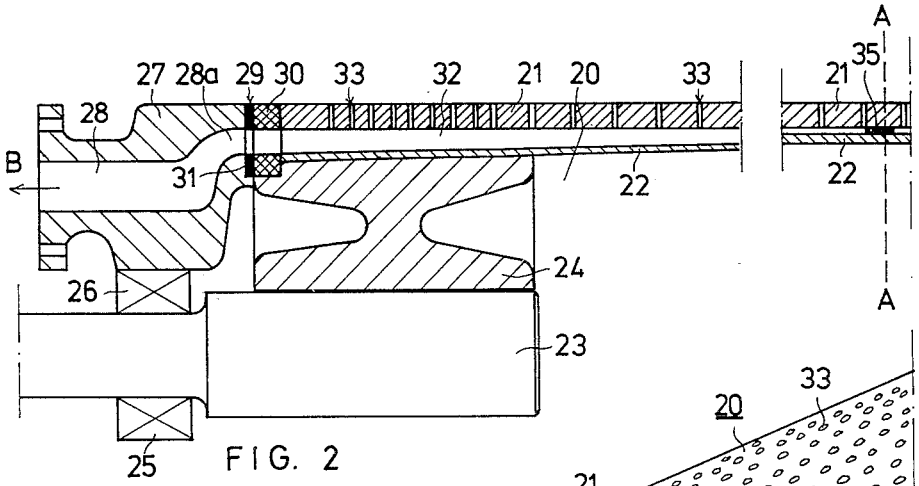
FIG. 2 is a partly schematic fragmentary longitudinal section of part of a transfer means of the invention taken in a plane which contains the axis of the suction roll of the invention, FIG. 2 being taken along the line I—I of FIG. 4 in the direction of the arrows.
Figure 3:
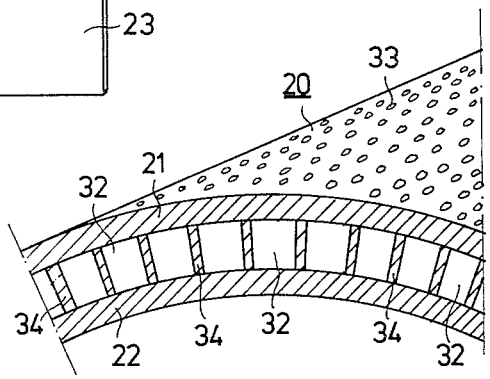
FIG. 3 is a fragmentary perspective partly sectional illustration of the inner and outer shells of the suction roll and a system of suction cells therebetween.

A seal means is provided for sealing the connection between the suction chamber means 27 and the perforations of the shell 21, through the cells 32, without using seal water. This seal means includes a stationary sealing gland or packing 31 which is fixed to the right end face of the member 27, as viewed in FIG. 2, surrounding the arcuate inlet end 28*a* of the hollow interior 28 of the suction chamber means 27. On the other hand, the seal means includes an annular packing or seal member 30 carried by the suction roll means 20 at the ends of the shells 21 and 22 situated adjacent the member 27. Thus, the member 30 has a width sufficiently great to extend across and beyond the cells 32 while being formed with openings aligned with the cells 32 so that through these openings the cells 32 will communicate through the sealing member 31 with the inlet end 28*a* of the chamber 28. Of course, the member 30 is fixed to the shells 21, 22 as well as to the wall 24 for rotation with the suction roll. The sealing elements 31 and 30 engage each other at a sealing surface 29 where the member 30 slides along the member 31, and of course, as pointed out above, no sealing water is applied. At the central part A—A of the suction roll means 20 of the invention a bracing ring 35 is provided as shown at the right of FIG. 2 for the purpose of bracing the suction roll at the central region of the shells 21 and 22. However it is to be noted that such a bracing ring is used only in those cases where the cells 32 are open at both ends of the suction roll and a pair of the suction chamber means 27 together with the seal means 29–31 are provided. In the event that the end of the roll opposite from that shown in FIGS. 2 and 4 has the cells 32 closed, the ring 35 will be omitted so that the suction will be distributed across the entire width of the roll. Of course the end wall 24 is fixed to the shaft 23 and is also fixed to the inner surface of the inner shell 22.

Figure 5:
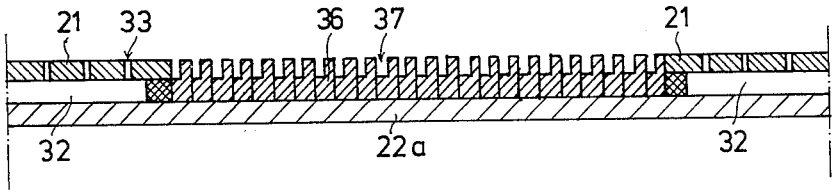
FIG. 5 is a fragmentary longitudinal sectional illustration of a further embodiment of a shell structure utilized for the suction roll of the invention.

With respect to the construction of the outer shell 21 particularly with respect to the perforations piercing through the latter and the exterior surface configuration thereof, there are various possibilities for achieving the results of the invention. Thus, in FIGS. 2–4 the exterior surface of the shell 20 is smooth over the entire area of this exterior surface. In the embodiment of FIG. 5, however, it will be seen that the central region of the shell is grooved.

Among the above possibilities for the construction of the shell 21 are the following:

a. The shell 21 may be uniformly perforated throughout with all of the perforations piercing through the shell while the system of suction cells are also distributed over the entire area of the shell at the inner surface thereof.

b. The shell may be uniformly perforated throughout but these perforations include openings at the central region of the shell which do not pierce through the shell. As a result the exterior surface of the shell is uniform throughout even though openings at the central region do not pierce the shell. With this construction also the system of suction cells will be distributed over the entire inner surface of the outer shell 21.

c. The outer shell 21 may be uniformly perforated throughout but instead of providing only part of the openings at the central region of the shell which do not pierce through the shell all of the openings at the central region of the shell do not pierce therethrough while the remainder of the openings between the central region and the outer end regions of the shell do pierce through the shell. In this case the cellular structure is only located where there are holes piercing through the shell.

d. The perforations which pierce through the shell may be relatively sparse and widely distributed at the central region of the shell while at the outer end regions of the shell there is a greater number of openings piercing therethrough per unit of shell area. It will be noted that such a construction is indeed illustrated in FIG. 2.

e. The outer shell 21 may be formed with perforations piercing therethrough only at the opposed end regions of the shell. The central intermediate region of the shell may be provided with circumferential grooves 37 as illustrated in FIG. 5. This construction may be provided by constructing the outer shell 21 of a pair of coaxial cylindrical bodies which are provided with the perforations 22 and which at their inner ends engage suitable sealing members carried by the outer surface of the inner shell 22*a* which is shown in FIG. 5. Between these inner ends of the parts of the outer shell 21 a suitably profiled strip 36 is wound around the inner shell 22*a* at the exterior surface thereof. This strip 36 is profiled as illustrated in FIG. 5 so as to achieve in this way the circumferential grooves 37. A construction of this type is shown in Finnish Pat. No. 45,583. With a construction as shown in FIG. 5 the system of suction cells 32 does not extend to the central region of the roll 20 and of course a pair of suction means 27 and sealing means 29–31 are provided at the opposed ends of the roll.

f. The surface at the exterior of the outer shell 21 at the central region thereof may be either smooth and unperforated or provided with grooves. At both end regions of the shell, however, perforations which pierce through the cell are situated in two zones or stages. Thus at each end region of the shell there is an outer stage nearest to the end of the shell and an inner stage nearer to the central region of the shell. At the outer zone or stage the area occupied by the spaces formed by the perforations may be on the order of, for example, 20–25% of the total shell area while at the inner zone between the outer zone and the central region, the area occupied by the total space formed by the perforations is only on the order of 10–15% or less of the total area of the shell at this inner stage.

The total area occupied by the perforations which pierce through the cell will depend, for example, on the type of paper which is manufactured and on the quality of the felt or drying wire used together with the transfer suction roll.

For the purposes of the present invention a relatively dense distribution of perforations may be considered a distribution according to which the total area of the spaces formed by the perforations, which is to say the total cross-sectional area of the perforations is on the order of 20–25% or more of the surface area of the shell where the perforations are situated. This free space defined by the perforations can be achieved either by a relatively large number of perforations of small diameter or a smaller number of perforations of large diameter. A relatively sparse distribution of perforations is to be understood as a distribution according to which the total space occupied by the perforations is on the order of 10–25% or less of the area of the shell where the perforations are located.

With respect to the system of suction cells situated between the outer shell 21 and the inner shell 22, this system may have a number of different advantageous constructions among which are the following:

a. The partitions 34 are situated in radial planes and extend parallel to the roll axis, as set forth above. The cells are of a constant height and breadth. In other words the radial dimension of all the cells is constant and the circumferential dimension of all the cells is constant. Thus, with such an embodiment all of the cells respectively have a constant cross-sectional area over the entire suction roll.

b. The cells 32 may extend parallel to the axis of the roll but the height or radial dimension of the cells is smaller at the central region of the roll than at the end regions thereof.

c. The partitions 34 of the cells 32 extend along a gentle helix starting at the center of the roll 20.

d. The cells 32 are situated only at the end regions of the roll at portions of the outer shell 21 thereof where the perforations are located. In other words the system of suction cells includes only cells which are situated where perforations are situated.

The suction roll means 20 of the invention having any of the above constructions also has certain characteristic features for reducing unnecessary air suction and parasitic air, so that any unnecessary loading of the suction pump is avoided. This result is achieved by the following features:

a. A relatively small hole capacity is provided in the outer shell. This small hole capacity is achieved by reducing the number of holes 33 which pierce the shell 21 so that the number of holes 33 is as small as possible, and either in addition to this latter feature or as an alternative thereto the desired result is achieved by using a relatively thin outer shell 21. Such a thin outer shell is rendered possible with the transfer suction roll means of the invention because the required strength of the roll 20 is achieved with the aid of the inner shell 22.

b. A small cell capacity may be provided. Such a small cell capacity is possible because the cells 32 have a relatively small height or radial dimension and they are exclusively dimensioned in consideration of the required airflow so that the cross-sectional area of the cells 32 need only equal the combined cross-sectional area of the holes in the corresponding suction zone. In other words if a given number of holes are distributed over a given portion of the outer shell, only this latter portion need communicate with a cell 32 so that the axial and circumferential dimension of the cell need only correspond to the axial and circumferential dimension of the perforated shell area which communicates with the particular cell, while the radial dimension of the cell, or in other words the height thereof, can be quite small, cutting down in this way on the volume of air which must be handled by the suction pump.

Of course, it is possible to practice the invention in certain applications with a transfer suction roll means which does not have a system of suction cells so that the suction rolls means is not of a cellular construction. In certain applications it is possible to arrange a conventional transfer suction roll so as to be at least substantially free of seal water and thus be appropriate for use according to the present invention. For example, the roll 2*f* of FIG. 7 may be such a roll, although it can of course also have the construction described above in connection with the transfer section roll means 20 of the present invention.

What is claimed is:

1. In a paper-manufacturing machine, press section means for dewatering a web received by said press section means from a wire while said web travels through said press section means to a drying section of the machine, said press section means including a press roll and a transfer means cooperating with said press roll for transferring the web from said press roll away from the latter toward the drying section, and said transfer means including at least a transfer suction roll means having an outer rotary shell formed with perforations through which suction is applied to the web, said outer rotary shell having opposed ends, suction chamber means situated outwardly beyond said shell closely adjacent to at least one of said ends thereof and communicating with said perforations of said shell at the interior of said shell at least through said one end thereof, and seal means situated at least at said one end of said shell between said suction chamber means and said shell for sealing an area through which said suction chamber means communicates with perforations of said shell at any given instant, so that seal water need not be applied to the interior of said shell to have access through said perforations thereof to the web.

2. The combination of claim 1 and wherein said press section means also includes means cooperating with said press roll for defining therewith a plurality of nips and for providing for the web a path from the wire to said transfer means along the entire length of which the web is at all times supported.

3. The combination of claim 1 and wherein an endless felt extends between said transfer suction roll means and said press roll for defining with said press roll a nip just prior to detachment of the web from said press roll by said transfer means.

4. The combination of claim 1 and wherein said transfer suction roll means has a pair of opposed end regions and an intermediate central region situated between said pair of opposed end regions, and suction means formed at least in part by said suction chamber means, said seal means, and said perforated shell for applying at the region of said opposed ends of said transfer suction roll means a suction force greater than at said intermediate central region.

5. The combination of claim 4 and wherein said suction means includes means providing between said opposed end regions and said intermediate central region a suction force which diminishes at least in stages from said end regions toward said central region.

6. The combination of claim 4 and wherein said suction means includes means providing a force of suction extending from said opposed end regions toward but not up to said central region so that at the latter region there is no suction.

7. In a paper-manufacturing machine, press section means for dewatering a web received by said press section means from a wire while said web travels through said press section means to a drying section of the machine, said press section means including a press roll and a transfer means cooperating with said press roll for transferring the web from said press away from the latter toward the drying section, and said means including at least a transfer suction roll means having an outer rotary shell formed with perforations through which suction is applied to the web, suction chamber means communicating with said perforations of said shell, and seal means between said suction chamber means and said shell for sealing an area through which said suction chamber means communicates with perforations of said shell at any given instant, said transfer suction roll means including, in addition to said outer perforated shell, an inner non-perforated shell surrounded by and situated adjacent and spaced at least in part from said outer shell, and cell-defining means situated between said inner and outer shells for defining a system of suction cells therebetween, and said suction chamber means being situated at the region of at least one end of said transfer suction roll means for communicating through said system of suction cells with perforations of said outer shell and said seal means being situated between said suction chamber means and end regions of said inner and outer shells.

8. The combination of claim 7 and wherein said suction chamber means is situated at only one end of said transfer suction roll means, the opposed end of the latter being closed.

9. The combination of claim 7 and wherein said system of suction cells is open at opposed ends of said transfer suction roll means, and a pair of said suction chamber means respectively being situated at said opposed ends of said suction roll means for communicating with said system of suction cells, a pair of said seal means being situated between the pair of suction chamber means and opposed end regions of said shells.

10. The combination of claim 9 and wherein said suction cell system extends inwardly from the opposed ends of said suction roll means toward a central region thereof and means at said central region separating and preventing communication between the parts of said cell system which respectively extend inwardly from the opposed ends of said suction roll means toward said central region thereof.

11. The combination of claim 7 and wherein a circular bracing ring is situated between said shells at a central region of said transfer suction roll means for bracing said transfer suction roll means between said outer and inner shells thereof.

12. The combination of claim 7 and wherein said system of suction cells include spaces of a greater cross-sectional area at opposed end regions of said shells than at a central region thereof.

13. The combination of claim 7 and wherein said outer shell is substantially uniformly perforated over its entire area for communicating with said system of suction cells.

14. The combination of claim 7 and wherein said outer shell has a pair of opposed ends and a central region situated midway between said pair of opposed ends, and said outer shell being formed with perforations extending from said central region toward said opposed ends for communicating with said system of suction cells while said central region is formed with openings which at the exterior surface of said outer shell have a configuration and distribution similar to said perforations but which do not extend through said outer shell.

15. The combination of claim 7 and wherein said outer shell has opposed end regions and a central region situated midway between said opposed end regions, and said outer shell being formed with perforations passing therethrough for providing communication through said outer shell to said system of suction cells, and said perforations having at said central region a total area substantially less than the total area of said perforations between said central region and said opposed ends of said outer shell.

16. The combination of claim 7 and wherein said outer shell has a central region and a pair of opposed end regions and is formed with perforations only between said opposed end regions.

17. The combination of claim 16 and wherein said central region of said outer shell has a smooth exterior surface.

18. The combination of claim 16 and wherein said central region of said outer shell has an exterior surface formed with grooves.

19. The combination of claim 18 and wherein said central region of said outer shell is formed by an elongated strip wound around and engaging said inner shell and having a profile which forms said grooves.

20. The combination of claim 7 and wherein a plurality of partitions which are situated substantially in radial planes which include the axis of said suction roll means are situated between said inner and outer shells for defining said system of suction cells.

21. The combination of claim 20 and wherein said partitions are parallel to said axis.

22. The combination of claim 7 and wherein said outer shell is formed with perforations only at predetermined regions of said outer shell and said system of suction cells communicating only with said perforated regions of said outer shell.

23. A press mechanism for removing water from a traveling fibrous web formed on a forming section of a machine comprising in combination: a first press roll and second press roll beneath it forming a first horizontally extending press nip; a third press roll positioned on the up-running side of the first press roll to form a second press nip: a fourth press roll positioned above the third press roll forming a third press nip therewith; a fifth press roll on the down-running side of the third press roll forming a fourth press nip therewith; a web carrying first felt extending through said first and second nips; a second felt extending through the first nip on the opposing side of the web to form a double felted first nip so that the web is dewatered in both directions; a third felt passing through said third press nip; a fourth felt passing through said fourth press nip with the web being separated from the third roll on the down-running side thereof following said fourth press nip, said web being supported continuously in travel through the nips; and transfer suction roll means cooperating with third press roll subsequent to said fourth press nip for transferring the web away from said third press roll toward a drying section of the machine, said transfer suction roll means having an outer rotary shell formed with perforations through which suction is applied to the web, said outer rotary shell having opposed ends, suction chamber means situated outwardly beyond said shell closely adjacent to at least one of said ends thereof and communicating with said perforations of said shell at the interior of said shell at least through said one end thereof, and seal means situated at least at said one end of said shell between said suction chamber means and said shell for sealing an area through which said suction chamber means communicates with perforations of said shell at any given instant, so that seal water need not be applied to the interior of said shell to have access through said perforations thereof to the web.

24. A press mechanism for removing water from a traveling fibrous web formed on a forming section of a machine comprising in combination: first and second rolls defining a first press nip therebetween; a third press roll forming a second nip with said first roll; a fourth press roll forming a third nip with the third press roll; a web carrying first felt passing through the first nip following the first roll and thereafter passing through the second nip separating from the web after the second nip with the web following the third roll after said second nip to pass through the third nip; a second felt passing through the first nip on the side of the web opposite said first felt so that the web is initially dewatered in both directions; a third felt passing through said third nip with the web, said web passing sequentially through said first, second and third nips being supported continually between nips; and transfer suction roll means cooperating with said third press roll subsequent to said third nip for transferring the web away from said third roll toward a drying section of the machine, said transfer suction roll means having an outer rotary shell formed with perforations through which suction is applied to the web, said outer rotary shell having opposed ends, suction chamber means situated outwardly beyond said shell closely adjacent to at least one of said ends thereof and communicating with said perforations of said shell at the interior of said shell at least through said one end thereof, and seal means situated at least at said one end of said shell between said suction chamber means and said shell for sealing an area through which said suction chamber means communicates with perforations of said shell at any given instant, so that seal water need not be applied to the interior of said shell to have access through said perforations thereof to the web.

25. A press mechanism for removing water from a traveling fibrous web formed on a forming section of a machine constructed in accordance with claim 24; wherein said first and second rolls are substantially in vertical alignment and said first felt travels in substantially a horizontal path from the location of receiving the web through said first nip.

26. A press mechanism for removing water from a traveling fibrous web formed on a forming section of a machine constructed in accordance with claim 24; wherein said first roll is a suction roll; and a suction gland is included within the first roll extending between the first and second nips.

27. A press mechanism for removing water from a traveling fibrous web formed on a forming section of a machine constructed in accordance with claim 24; wherein said first roll is a suction roll and suction glands are provided opposite the first felt in said first said second nips.

28. A press mechanism for removing water from a traveling fibrous web formed on a forming section of a machine constructed in accordance with claim 24; wherein said first roll is a suction roll and a suction gland is positioned opposite said first nip, and said second roll contains grooves in the outer peripheral surface.

29. A press mechanism for removing water from a traveling fibrous web formed on a forming section of a machine constructed in accordance with claim 24; wherein said third roll is a plain roll with a smooth outer surface.

* * * * *